United States Patent [19]

Gasser

[11] Patent Number: 4,655,623

[45] Date of Patent: Apr. 7, 1987

[54] INK RIBBON CASSETTE

[75] Inventor: Karl Gasser, Hallau, Switzerland

[73] Assignee: Franz Buttner AG, Egg, Switzerland

[21] Appl. No.: 807,409

[22] Filed: Dec. 10, 1985

[30] Foreign Application Priority Data

Dec. 13, 1984 [CH] Switzerland ..... 5935/84

[51] Int. Cl.[4] ..... B41J 32/00

[52] U.S. Cl. ..... 400/208; 400/228; 400/234

[58] Field of Search ..... 400/207, 208, 208.1, 400/228, 234, 235, 236, 249; 242/192, 199

[56] References Cited

U.S. PATENT DOCUMENTS

| | | | |
|---|---|---|---|
| 4,317,636 | 3/1982 | Hume | 400/228 X |
| 4,339,210 | 7/1982 | Craft et al. | 400/208 |
| 4,406,554 | 11/1983 | Dreinhoff et al. | 400/249 |
| 4,502,801 | 3/1985 | Hefti et al. | 400/208 |
| 4,523,868 | 6/1985 | Shadwick | 400/228 X |
| 4,605,327 | 8/1986 | Ueki et al. | 400/228 X |
| 4,609,298 | 9/1986 | Shioda et al. | 400/228 X |

FOREIGN PATENT DOCUMENTS

| | | | |
|---|---|---|---|
| 83926 | 7/1983 | European Pat. Off. | 400/208 |
| 0122755 | 10/1984 | European Pat. Off. . | |
| 1290 | 1/1984 | Japan . | |

*Primary Examiner*—Charles A. Pearson

*Attorney, Agent, or Firm*—Blum Kaplan

[57] ABSTRACT

An ink ribbon cassette for winding an ink ribbon from a feed spool to a winding spool is provided. The cassette includes a base with a guide path for receiving a guide projection formed on a support member having a feed spool sleeve. A drive roller and controlling roller are rotatably mounted on the cassette base. A winding spool is rotatably mounted on the feed spool sleeve and biased towards the drive roller, and a feed spool is rotatably mounted on the feed spool sleeve and biased towards the controlling roller. The spool sleeves are positioned so that when the guide projection of the support moves within the guide path the winding spool operatively engages the drive roller and the support member pivots about the guide projection so that when the ribbon is wound from the feed spool to the winding spool, the feed spool maintains engagement with the controlling roller.

13 Claims, 6 Drawing Figures

INK RIBBON CASSETTE

BACKGROUND OF THE INVENTION

This invention relates in general to ink ribbon cassettes, and in particular to ink ribbon cassettes containing a feed spool and a winding spool for use in printing applications.

Dual spool cassettes are known in the art as disclosed in U.S. Pat. No. 4,406,554. In this cassette both the feed spool and the winding spool are guided in slots in the housing. The feed spool is pressed by a spring against a roller rotatably supported in the housing. The winding spool is urged by a spring against a drive roller which is engaged by a drive shaft of the typewriter or printer. These cassettes are advantageous in that they enable automatic detection of the tape's end.

Another such ribbon cassette is shown in European Patent Application No. 122,755. In this cassette, a slide is slideably supported in the housing. Two pins project from the slide, one of which supports a feed spool, the other pin supports a winding spool. The slide is urged by a spring against a drive roll which is engaged by a drive shaft of the typewriter. This is advantageous in that the axis of the two spools are aligned and do not tilt resulting in safer operation and reduced friction.

These prior art cassettes have been satisfactory; however, they suffer from the disadvantage that the pressure of the winding spool against the drive roll varies with the spool diameter. The spring must be constructed and placed so that the minimum pressure required to drive the winding spool is guaranteed. Therefore, the pressure actually increases too much as the diameter of the winding spool increases. This results in frictional losses and high torque required from the driveshaft of the typewriter or printer. Another disadvantage is that in some of the prior art devices the two spools are not perfectly guided and tend to tilt. Accordingly, it is desireable to provide an ink ribbon cassette for two spooled cassettes which overcome the shortcomings of the prior art devices described above.

SUMMARY OF THE INVENTION

Generally speaking, in accordance with the invention, an ink ribbon cassette having an improved feed and winding system is provided. The cassette includes a take-up spool and a feed spool mounted at opposite ends of an elongated support which is slideably and pivotably mounted in a cassette housing. Coaxial with the winding spool, the support has a displaceable guiding peg which can be moved between two bridges rigidly connected with the housing. A first leg of a spring acting on the support forces the winding spool against a drive roller rotatably mounted in the housing. The support is capable of swinging around the axis of the peg and is biased in a direction by a second leg of the spring, to urge the feed spool against a controlling roller rotatably mounted in the housing. The forces applied to the support decrease with increase in the diameter of the winding spool, so that the contact force of the winding spool acting on the drive roll remains substantially constant.

It is an object of this invention to provide an improved feed and take up system for an ink ribbon cassette.

Another object of this invention is to provide an ink ribbon cassette in which the pressure of the winding spool against the drive roller is almost independent of the diameter of the winding spool.

A further object of this invention is to provide an ink ribbon cassette that enables automatic detection of the end of the ribbon.

Still another object of the invention is to provide an ink ribbon cassette where the two spools are perfectly guided and cannot tilt.

Still a further object of this invention is to provide an ink ribbon cassette which combines the advantages of the prior art cassettes yet does not have the disadvantages of the prior art cassettes.

Still other objects and advantages of the invention will in part be obvious and will in part be apparent from the specification and drawings.

The invention accordingly comprises features of construction, combination of elements, and arrangement of parts which will be exemplified in the construction hereinafter set forth and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
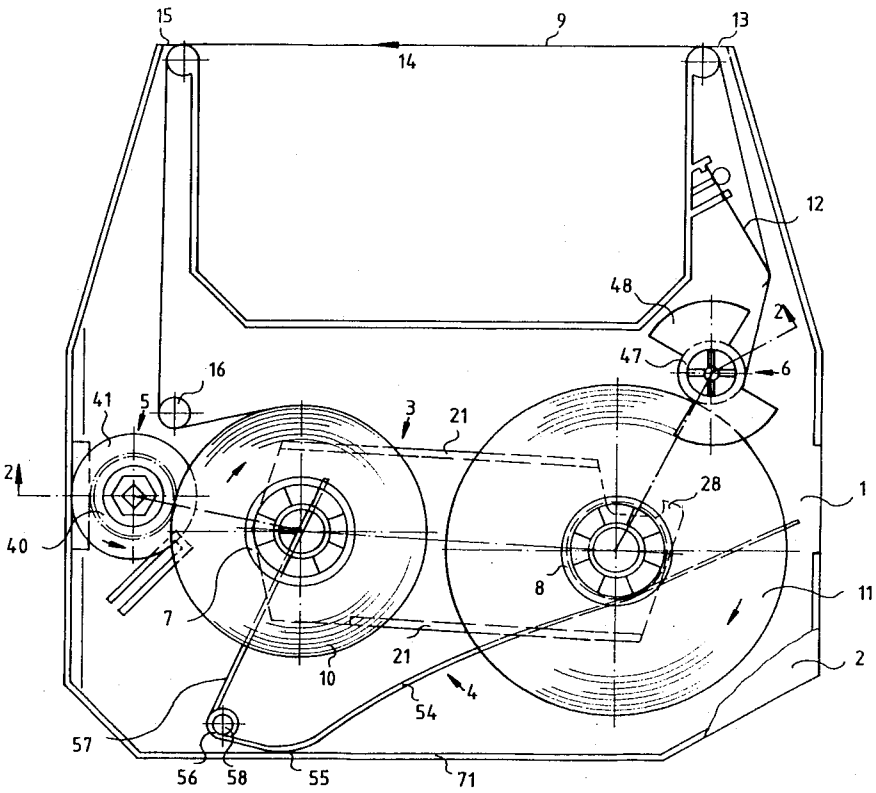
FIG. 1 is a top plan view of an ink ribbon cassette in accordance with the invention with the cover partially removed.

Reference is made to FIG. 1, wherein a plan view of an ink ribbon cassette constructed in accordance with the invention is shown. The cassette includes a casing base 1 and a casing top 2, a portion of which is shown. A feed spool 11 and a winding spool 10 of an ink ribbon 9 are rotatably supported on a common support 3. By means of a spring 4, winding spool 10 is biased against and cooperates with a drive roller 5. Feed spool 11 is biased against and cooperates with a controlling roller 6 for controlling the movement of ribbon 9. By rotation of drive roller 5, ribbon 9 is taken off feed spool 11 in the direction shown by the arrow in FIG. 1, and transported to winding spool 10 by way of controlling roller 6, a leaf spring 12, an outlet opening 13, a printing location 14, an inlet opening 15 and a reversing roller 16.

Figure 2:
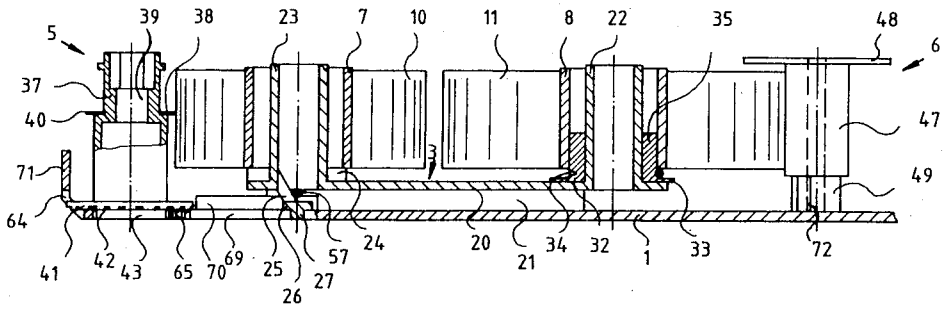
FIG. 2 is a cross-sectional view of the cassette taken along line II—II of FIG. 1.

Reference is now also made to FIG. 2. A support 3 includes a plate 20 with two sleeves 22 and 23 vertically extending from said plate 20. Below plate 20 are two ribs 21 resting on casing base 1. The cores 7 and 8 of feed spool 11 and winding spool 10, respectively, are rotatably supported on sleeves 22, 23. In order to brake feed spool 11 core 8 engages tappets 35 of a braking sleeve 32 supported on sleeve 22. Braking sleeve 32 has at its bottom a flange 33, a groove 34 and a leg 54 of spring 4 pushes against groove 34. The force of spring leg 54 acting on brake sleeve 32 is nearly constant while the system is in operation. Therefore, the friction of leg 54 on braking leg 32 produces a braking torque that is defined within narrow limits. Winding core 7 rests on a shoulder 24 constructed and positioned to conform with the thickness of flange 33 and groove 34.

A round guide peg 26 is secured on plate 20 by way of a bridge 25 with peg 26 being disposed coaxially with sleeve 23. An indicator pin 27 mounted onto the bottom of and coaxially with peg 26 projects into a slot 69 of casing base 1. On the outer side of casing base 1 a scale is fitted adjacent to the slot 69 which permits evaluation of the available supply of ribbon.

Figure 3:
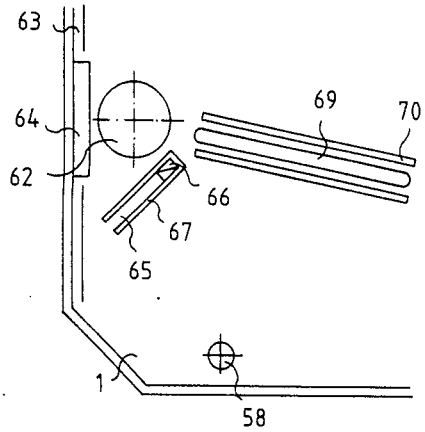
FIG. 3 is a partial top plan view of the bridges of the cassette of FIG. 1.

Referring also to FIG. 3, parallel to slot 69, two guide projections 70 extend in a way such that guide peg 26 is guided there between. A second leg 57 of spring 4 is inserted between plate 20 and guide peg 26 and rests against bridge 25.

Spring 4, with many windings 56, is wound around a pin 58, which is rigidly connected with casing base 1, and rests on a lateral casing wall 71 with a curvature 55. Support 3 is adapted to pivot freely around the axis of guide peg 26. The force of leg 57 of spring 4 acting on bridge 25 presses winding spool 10 against drive roller 5. This force increases with the increase in elastic tension of leg 57. At the same time, leg 54 of spring 4 presses support 3 counterclockwise against feed spool 11 and presses feed spool 11 against controlling roller 6.

Figure 6:
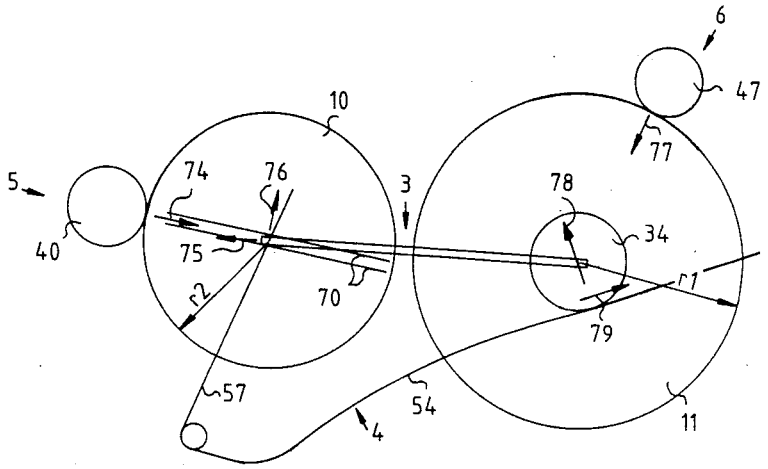
FIG. 6 is a schematic representation of the forces acting upon each roller.

Reference is now also made to FIG. 6 which schematically shows the forces acting upon sleeve 22. These forces include a spring force 78 and a braking force 79, as well as a force 77 of controlling roller 6 pressing in cooperation with feed spool 11. The resultant of the three forces has a component in the direction of drive roller 5, thus increasing the force of drive roller 5 acting on windup spool 10. This force is a function of a spring force 75 of spring leg 57. This component is high if support 3 has been displaced far to the left when the ribbon on winding spool 10 is small. Therefore, the force component resulting from the forces of the spring leg 54 and roller 6 decreases as the size of winding spool 10 increases with the increase in the force of leg 57 acting on bridge 25. Rolls 5 and 6 are arranged with respect to each other as well as guide projection 70 in accordance with the initial diameter of feed spool 11. The spacing of sleeves 22 and 23 may be optimized in such a way that the force of drive roller 5 acting on winding spool 10 remains practically constant while the ribbon is being wound. The path of guide peg 26, which is defined by guide projections 70, extends through the axis of drive roller 5, so that a guiding force 76 acting on the peg 26 does not contribute to force 74.

Drive roller 5 is provided with a square shaped depression 39 for engaging a drive of a printer. A metallic jagged wheel 40 with sharp edged teeth is secured on shoulder 38 of a roller body 37 for transmitting the driving torque to winding spool 10. Roller body 37 has a ratchet wheel 41 disposed at its bottom with grooves 42 working with a catch 66. Catch 66 is disposed at one end of a spring 65 which is formed by a U-shaped opening 67 in casing base 1. A peg 43 of roller body 37 is supported in a bore 62 of casing base 1. A bevel 63 is provided between lateral casing wall 71 and casing base 1 within the range of drive roller 5. Ratchet wheel 41 projects laterally through a window 64 in bevel 63, so that drive roller 5 can be operated by hand, for example for the purposes of tensioning ribbon 9. In the opposite direction, the drive is locked by catch 66.

Figure 5:
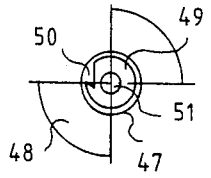
FIG. 5 is a bottom plan view of the cut off roller.
Figure 4:
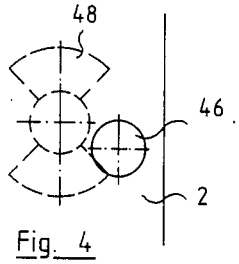
FIG. 4 is a top plan view of the ink ribbon cassette showing the controlling roller in phantom.

Reference is now also made to FIG. 4 and FIG. 5. Controlling roller 6 has a bored-through center 51 and is rotatably supported on a pin 72 which is rigidly mounted on casing base 1. A lug 48 is supported on a roller body 47. Lug 48 is periodically visible in a window 46 of casing top 2 when the system is in operation. Lug 48 permits controlling the advancement of ribbon 9 and automatic shutoff of the printer when lug 48 comes to a stop during the operation of the printer, as when feed spool 11 is nearly empty. So as to safely achieve such shutoff safely before feed spool 11 is completely empty and to assure sufficient tension of ribbon 9 until the end of the printing operation, a hook 28 is provided on support 3. Hook 28 cooperates with a cutoff cam 50 on a peg shaped extension 49 of controlling roller 6 to prevent further advancement of ribbon 9. When feed spool 11 is nearly empty, cam 50 seizes hook 28, stopping controlling roller 6. Since roll body 47 is smooth, ribbon 9 can be transported still further over a small distance even while the controlling roller 6 is being blocked, for example in order to complete a line. In this case, however, a higher braking torque is acting on feed spool 11.

Accordingly, by providing an ink ribbon cassette including a drive roller and a controlling roller which are rotatably supported in a casing base, and a support rotatably supporting at its one end a feed spool and at its other end a winding spool, and a spring with a first leg acting on the support to press the winding spool against the drive roller and a second leg of the spring swinging the support around the axis of a guide peg, and pressing the feed spool against the controlling roller; the drive motor of the printer need only be slightly oversized. Also, the ink ribbon cassette in accordance with the invention is particularly well suited to provide for maintaining a pressure of the winding spool against the drive roller which remains relatively constant as the diameter of the winding spool increases. Finally, the ink ribbon cassette in accordance with the invention is particularly well suited to provide a cassette where the feed spool and winding spool are perfectly guided and cannot tilt.

It will thus be seen that the objects set forth above, among those made apparent from the preceding description, are efficiently attained and since certain changes may be made in the above construction without departing from the spirit and scope of the invention, it is intended that all matters contained in the above description or shown in the accompanying drawings shall be interpreted as illustrative and not in a limiting sense.

It is also understood that the following claims are intended to cover all the generic and specific features of the invention herein described and all statements of the scope of the invention which, as a matter of language, might be said to fall therebetween.

What is claimed is:

1. An ink ribbon cassette for winding an ink ribbon from a feed spool to a winding spool within the cassette, comprising:

a cover, a base formed with a guide path for receiving a guide projection;

at least one side wall connecting the cover and base, a drive roller rotatably supported on the cassette base, a controlling roller rotatably supported on the cassette base, a support member having a feed spool sleeve and a winding spool sleeve, said support member formed with the guide projection for sliding in the guide path formed in the cassette base;

a feed spool rotatably mounted on the feed spool sleeve and biased towards and engaging the controlling roller; and a winding spool rotatably mounted on the winding spool sleeve and biased towards and engaging the drive roller;

the spool sleeves positioned so that when the guide projection of the support member moves within the guide path, the winding spool operatively engages the drive roller and the support member pivots about the guide projection so that when the ribbon is wound from the feed spool to the winding spool the feed spool maintains engagement with the controlling roller.

2. The ink ribbon cassette of claim 1, further including a spring for biasing the feed spool on the support member towards the controlling roller and biases the winding spool on the support member towards the drive roller.

3. The ink ribbon cassette of claim 2, wherein the spring is a wire spring secured to the base having two legs, one of the legs biasing the winding spool toward the drive roller and the other leg pivoting the support member about the guide projection for biasing the feed spool towards the controlling roller.

4. The ink ribbon cassette of claim 1, further including brake means for regulating rotation of the feed spool.

5. The ink ribbon cassette of claim 4, wherein the brake means includes a braking sleeve formed with a groove rotatably supported on the feed spool sleeve, the braking sleeve being coupled with the feed spool and one leg of the spring engaging the groove of the braking sleeve.

6. The ink ribbon cassette of claim 1, wherein the guide projection is a peg mounted on the support member on a surface opposite to the sleeve and disposed coaxially with the winding spool.

7. The ink ribbon cassette of claim 6, wherein the guide path includes a slot in the case bottom, the slot extending the length of the guide path and the peg extends through the slot.

8. The ink ribbon cassette of claim 7, wherein the support member is spaced apart from the cassette base with the first spring leg resting against the peg between the support member and the base.

9. The ink ribbon cassette of claim 1, wherein the controlling roller is formed with a cut-off cam and the support member is formed with a cooperating hook, the hook engaging the cut-off cam to stop the controlling roller when the feed spool is nearly empty.

10. The ink ribbon cassette claim 1, wherein the driving roller is formed with teeth for engaging the outer surface of the ribbon wound on the take-up spool.

11. The ink ribbon cassette of claim 1, further including ratchet means formed on the end of the driving roller which projects through the casing bottom for turning the winding spool.

12. An ink ribbon cassette for winding an ink ribbon from a feed spool to a winding spool within the cassette, comprising:

a cover, a base formed with a guide path for receiving a guide projection;

at least one side wall connecting the cover and base, a controlling roller rotatably supported on the cassette base, a drive roller rotatably supported on the cassette base, a support member having a feed spool sleeve and winding spool sleeve and formed with the guide projection for sliding in the guide path, said projecting guide being a peg mounted on the support member on a surface opposite to the sleeve and disposed coaxially with the winding sleeve, a feed spool rotatably mounted on the feed spool sleeve and biased towards and engaging the controlling roller, a winding spool rotatably mounted on the winding spool sleeve and biased towards and engaging the driving roller, a wire spring secured to the cassette base having two legs, one of the legs biasing the winding spool toward the drive roller and the other leg pivoting the support member about the guide projection for biasing the feed spool towards the controlling roller, a braking sleeve formed with a groove mounted on the feed spool sleeve and one leg of the spring engaging the groove of the braking sleeve, and the drive roller formed with teeth for engaging the outer surface of the ribbon wound on the take up spool and ratchet means projecting through the casing bottom for turning the winding spool;

the spool sleeves positioned so that when the guide projection of the support member moves within the guide path, the winding spool operatively engages the drive roller and the support member pivots about the guide projection so that when the ribbon is wound from the feed spool to the winding spool the feed spool maintains engagement with the controlling roller.

13. The ink ribbon cassette as claimed in claim 12, wherein the support member is formed with a cooperating hook, and the controlling roller is formed with a cut-off cam, said hook engaging the cut-off cam to stop the controlling roller when the feed spool is nearly empty.

* * * * *